US009770841B2

(12) United States Patent
Mohanram et al.

(10) Patent No.: US 9,770,841 B2
(45) Date of Patent: Sep. 26, 2017

(54) HOT PRESS AND METHOD OF USING

(71) Applicant: Saint-Gobain Ceramics & Plastics, Inc., Worcester, MA (US)

(72) Inventors: Aravind Mohanram, Northborough, MA (US); Brian P. Feldman, Northborough, MA (US); Yeshwanth Narendar, Westford, MA (US); John D. Pietras, Sutton, MA (US); F. Michael Mahoney, Holliston, MA (US); Wesley R. Robbins, East Brookfield, MA (US)

(73) Assignee: SAINT-GOBAIN CERAMICS & PLASTICS, INC., Worcester, MA (US)

( * ) Notice: Subject to any disclaimer, the term of this patent is extended or adjusted under 35 U.S.C. 154(b) by 253 days.

(21) Appl. No.: 14/717,253

(22) Filed: May 20, 2015

(65) Prior Publication Data

US 2015/0343663 A1 Dec. 3, 2015

Related U.S. Application Data

(60) Provisional application No. 62/005,144, filed on May 30, 2014.

(51) Int. Cl.
*B28B 3/02* (2006.01)
*B30B 15/34* (2006.01)
(Continued)

(52) U.S. Cl.
CPC ..... *B28B 3/025* (2013.01); *B30B 11/02* (2013.01); *B30B 15/34* (2013.01)

(58) Field of Classification Search
None
See application file for complete search history.

(56) References Cited

U.S. PATENT DOCUMENTS 5,211,786 A * 5/1993 Enloe ..... B22F 3/14 156/89.25
5,993,734 A 11/1999 Snowman et al.
(Continued)

FOREIGN PATENT DOCUMENTS

EP 1375121 A2 1/2004
EP 2210686 B1 12/2012
(Continued)

OTHER PUBLICATIONS

International Search Report and Written Opinion for PCT Application No. PCT/US2015/031713, dated Aug. 26, 2015, 15 pages.
(Continued)

*Primary Examiner* — Mary F Theisen
(74) *Attorney, Agent, or Firm* — Abel Law Group, LLP; Thomas Osborn

(57) ABSTRACT

Embodiments of the present disclosure relate to a hot press and methods of using the hot press. In an embodiment, the hot press can include a pressing element including a flared body. In another embodiment, the hot press can include a compression surface. The compression surface can include a first layer including a monocrystalline material and a second layer including a polycrystalline material, wherein the monocrystalline material and the polycrystalline material include a same primary compound. In a further embodiment, a sample including more than one layer of ceramic oxide material can be hot pressed without a die.

20 Claims, 4 Drawing Sheets

(51) Int. Cl.
*B30B 15/06* (2006.01)
*B30B 11/02* (2006.01)

(56) References Cited

U.S. PATENT DOCUMENTS

| | | | | |
|---|---|---|---|---|
| 7,550,217 | B2 | 6/2009 | Kwon et al. | |
| 2001/0010190 | A1* | 8/2001 | Urano | B30B 7/02 100/315 |
| 2004/0247971 | A1* | 12/2004 | Sarin | H01M 8/1213 429/482 |
| 2008/0286140 | A1* | 11/2008 | Zeitler | B28B 3/025 419/8 |
| 2010/0155993 | A1 | 6/2010 | Aalund et al. | |
| 2011/0201177 | A1 | 8/2011 | Fournel et al. | |
| 2012/0082531 | A1 | 4/2012 | Broyer et al. | |
| 2013/0189389 | A1 | 7/2013 | Kim et al. | |

FOREIGN PATENT DOCUMENTS

| | | | |
|---|---|---|---|
| KR | 20130128493 | A | 11/2013 |
| WO | 96/10489 | A1 | 4/1996 |

OTHER PUBLICATIONS

Thermal Technology LLC, High Temperature Experts, "Specifications, Group 1400 Silicon Carbide Hot Presses," dated May 24, 2007, 3 pages.

"Bench Top Hot Press Furnace," Oxy-Gon Industries, Inc., dated Apr. 2013, 4 pages.

Aalund, Robert, "Spark Plasma Sintering," Ceramic Industry Magazine, dated May 2008, 4 pages.

"5-10 Ton Hot Press Furnace," Materials Research Furnaces, Inc., dated Oct. 2014, <http://www.mrf-furnaces.com/5hp.htm>, 4 pages.

Sarin, Vinod et al., "Development of Hot Pressing as a Low Cost Processing Technique for Fuel Cell Fabrication," Oakridge National Laboratory, Final Annual Technical Progress Report, Jan. 6, 2003, 49 pages.

* cited by examiner

HOT PRESS AND METHOD OF USING

CROSS-REFERENCE TO RELATED APPLICATION

This application claims priority under 35 U.S.C. §119(e) to U.S. Provisional Patent Application 62/005,144 entitled "Hot Press And Methods Of Using," by Mohanram et al., filed May 30, 2014, which is assigned to the current assignee hereof and incorporated herein by reference in its entirety.

FIELD OF THE INVENTION

The present invention generally relates to hot press and methods of using the hot press.

BACKGROUND

Hot pressing is a technique for consolidating powder into a dense shape by the simultaneous application of pressure and heat. The powder can be placed into a hot press die for shaping to eliminate a cutting or machining process. Hot pressing may be used for fabrication of ceramics, hard alloy, powder metallurgy, and so on. Hot pressing can also be used in fabrication of multilayer ceramic products, such as solid oxide fuel cells (SOFC). However, improvement of hot pressed articles and methods of forming is desired by the industry.

BRIEF DESCRIPTION OF THE DRAWINGS

Embodiments are illustrated by way of example and are not limited by the accompanying figures.

Figure 1:
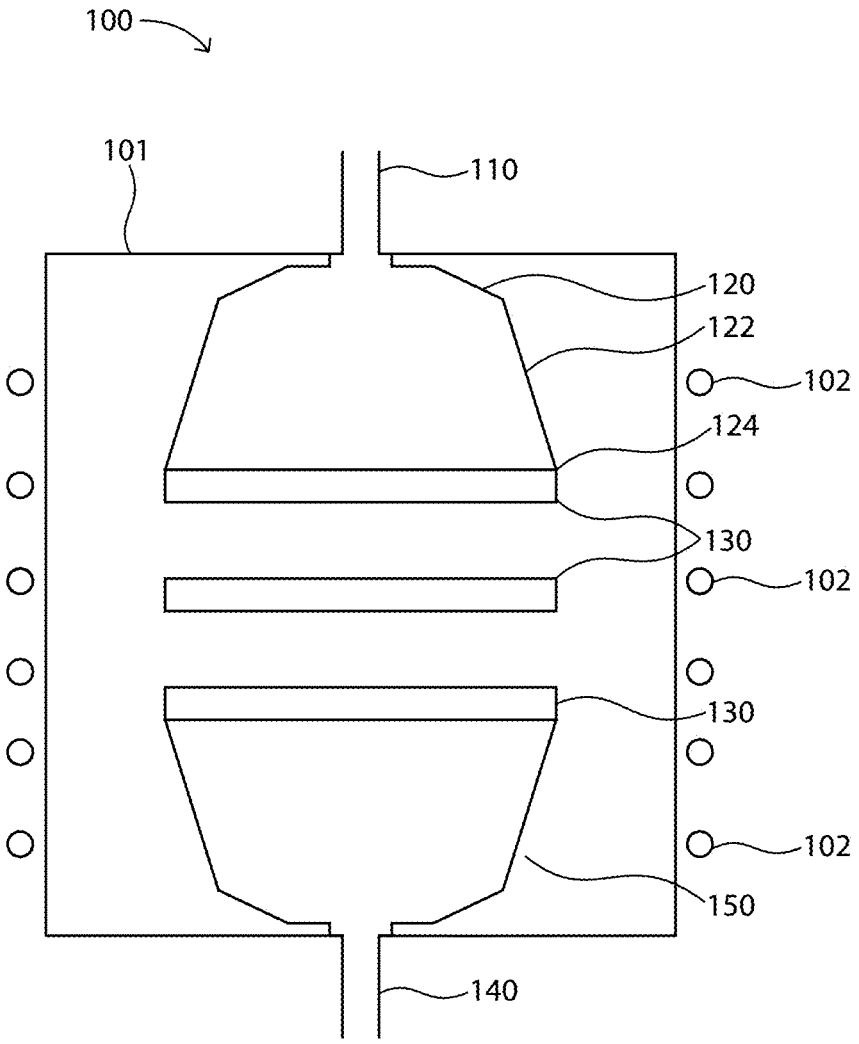
FIG. 1 illustrates a schematic sectional view of a hot press in accordance with an embodiment.

Skilled artisans appreciate that elements in the figures are illustrated for simplicity and clarity and have not necessarily been drawn to scale. For example, the dimensions of some of the elements in the figures may be exaggerated relative to other elements to help improve understanding of embodiments of the invention.

DETAILED DESCRIPTION

The following description in combination with the figures is provided to assist in understanding the teachings disclosed herein. The following discussion will focus on specific implementations and embodiments of the teachings. This focus is provided to assist in describing the teachings and should not be interpreted as a limitation on the scope or applicability of the teachings.

The term "compound" used herein refers to a molecular formula, not necessarily the structure corresponding to the formula. The molecular formula may have different crystalline structures such as a monocrystalline structure, one or more polycrystalline structures, or an amorphous structure, but all of the different structures have the same molecular formula. For example, $Al_2O_3$ can form a monocrystalline structure (sapphire) and a polycrystalline structure (for example, corundum or beta-$Al_2O_3$), but sapphire and the polycrystalline structure have the same compound, namely $Al_2O_3$. SiC can be in the form of alpha-SiC (6H—SiC) or beta-SiC (3C—SiC), and both of the structures have the same compound, namely SiC.

The term "primary" used herein to describe "compound" means the compound has the majority weight percentage of the material including the compound. The weight percentage of the primary compound can be greater than 50 wt %, greater than 80 wt %, or greater than 90 wt % of the total weight of the material. The materials having different structures but the same compound may include different impurities at a minority weight percentage, such as less than 50 wt %, less than 20 wt %, or less than 10 wt %.

The term "cycle time" used herein refers to a period of time of a cycle starting from room temperature to the temperature, going up and then back to room temperature. The term "room temperature" used herein refers to a temperature in a range of from 20° C. to 25° C.

The terms "comprises," "comprising," "includes," "including," "has," "having," or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive- or and not to an exclusive- or. For example, a condition A or B is satisfied by any one of the following: A is true (or present) and B is false (or not present), A is false (or not present) and B is true (or present), and both A and B are true (or present).

The use of "a" or "an" is employed to describe elements and components described herein. This is done merely for convenience and to give a general sense of the scope of the invention. This description should be read to include one or at least one and the singular also includes the plural, or vice versa, unless it is clear that it is meant otherwise.

Unless otherwise defined, all technical and scientific terms used herein have the same meaning as commonly understood by one of ordinary skill in the art to which this invention belongs. The materials, methods, and examples are illustrative only and not intended to be limiting. To the extent not described herein, many details regarding specific materials and processing acts are conventional and may be found in textbooks and other sources within the hot pressing and ceramic oxides arts.

A hot press can include a chamber with a heating element to provide heat to the chamber. The hot press can also be coupled to a hydraulic system or an electro-mechanical system to transmit pressure to an actuator, which in turn can be used to apply pressure to a sample. In an embodiment, the hot press disclosed herein can include a pressing element that includes a flared body that may help to apply the pressure more uniformly across a hot pressing sample being pressed. In another embodiment, the hot press can include a push rod that includes a silicon carbide. In a particular embodiment, the hot press may not include a die, and thus, an oxygen-containing species can diffuse more easily into the sample to keep a ceramic oxide from becoming reduced during hot pressing. Not using a die during hot pressing may also be beneficial for maintaining a desired thermal gradient between the center and edge of the sample.

FIG. 1 includes a schematic sectional view of a hot press. The hot press 100 can include a chamber 101. The chamber can have an upper wall, lower wall, and lateral walls extending between the upper wall and the lower wall. A heating element 102 can be arranged along one or more of the walls. In another embodiment, more than one heating element can be used to help to maintain a desired thermal gradient during hot pressing. In a further embodiment, the heating element can be arranged such that a higher temperature is reached where a sample is hot pressed, and have a lower temperature with increasing distance from the sample. In another embodiment, the temperature can be substantially uniform within the chamber. The heating element can include a silicon carbide, molybdenum disilicide, or the like.

The hot press 100 can include a push rod. The push rod can be hollow or solid. In an embodiment, the push rod can be attached to a cooling fixture such that a cooling fluid can be filled into or circulated through the hollow push rod to facilitate cooling. For example, air or water cooling can be implemented. In another embodiment, the push rod can be cylindrical or cuboid. In a further embodiment, the push rod can have a height along an axial direction. The push rod can also have a width and a length. The width and the length can be substantially the same as those of a sample being hot pressed. In another embodiment, the push rod can include a ceramic material, such as a silicon carbide, an aluminum oxide, a zirconia, a yttria, or the like. In a further embodiment, the push rod can include a silicon carbide. In a particular embodiment, the push rod can consist essentially of a silicon carbide.

In another embodiment, the hot press 100 can include more than one push rod, and each of the push rods can be coupled to a same hydraulic system at one end and coupled to a pressing element, as disclosed below, at the other end. For example, the hot press 100 can include push rods 110 and 140 that are aligned in an axial direction and coupled to pressing element 120 and 150, respectively, as illustrated in FIG. 1. The push rods 110 and 140 can push uniaxially toward each other.

In yet another embodiment, the hot press 100 can include a pressing element 120. The pressing element can include a flared body as illustrated in FIG. 1. For example, the flared body can have a shape of a trapezoid prism. The flared body can include side surfaces 122 that intersect an expanded major surface 124. The flared body and expanded major surface can help to spread the pressure so that the pressure can be transmitted uniformly to the sample. In another embodiment, the pressing element can have a different shape other than the flared body, such as cube, cuboid, cylinder, or hexagonal prism in accordance with the shape of the sample being hot pressed. In a further embodiment, the pressing element can include a ceramic material, such as a silicon carbide, an aluminum oxide, a zirconia, or any combination thereof. In still another embodiment, the hot press 100 can include more than one pressing element. For example, the hot press can include two pressing elements aligned along the axial direction, such as the pressing elements 120 and 150. In a further embodiment, the pressing element can be coupled to the push rod.

The hot press 100 can also include one or more compression surfaces 130. In an embodiment, the compression surface can include a platen. In another embodiment, the compression surface can include a stack of platens. The platen can include a silicon carbide, an aluminum oxide, or any combination thereof. In another embodiment, the compression surface 130 can include a plurality of layers that have a similar coefficient of thermal expansion. For example, the compression surface 130 can include a layer including a monocrystalline material and another layer including a polycrystalline material. The monocrystalline material and the polycrystalline material can include the same primary compound, such as $Al_2O_3$. For example, the monocrystalline material can be sapphire, and the polycrystalline material can be corundum.

The hot press 100 can include at least one compression surface (i.e. a platen) that is attached to the major surface 124 of the pressing element. In a further embodiment, the layer including the polycrystalline material can be attached to the major surface of the pressing element. Alternatively, the compression surface 130 can be free, not attached to the pressing element of the hot press, and positioned between a sample and the pressing element before hot pressing. In addition, one or more free compression surfaces can be used to separate samples so that multiple samples can be hot pressed simultaneously. For example, 3, 5, or more free compression surfaces can be used in one hot pressing operation. In a further embodiment, the compression surfaces are aligned in the axial direction with the pressing element.

Figure 2:
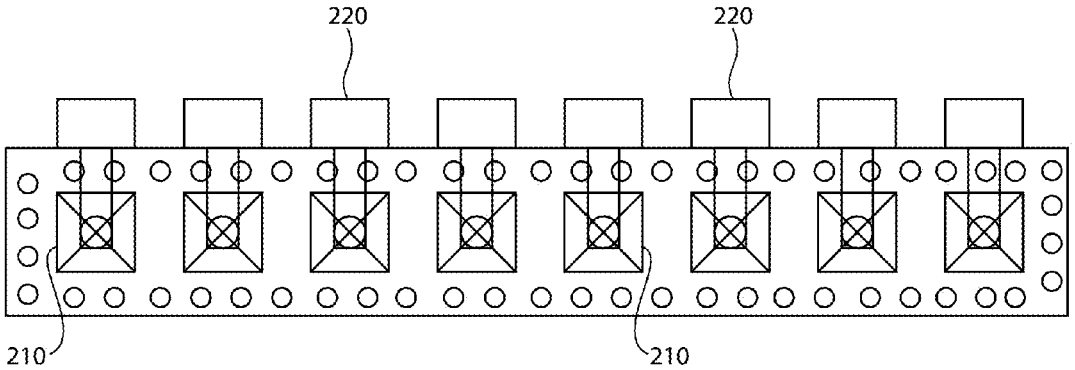
FIG. 2 illustrates a top view of a hot press including a plurality of pressing units in accordance with an embodiment.
Figure 3:
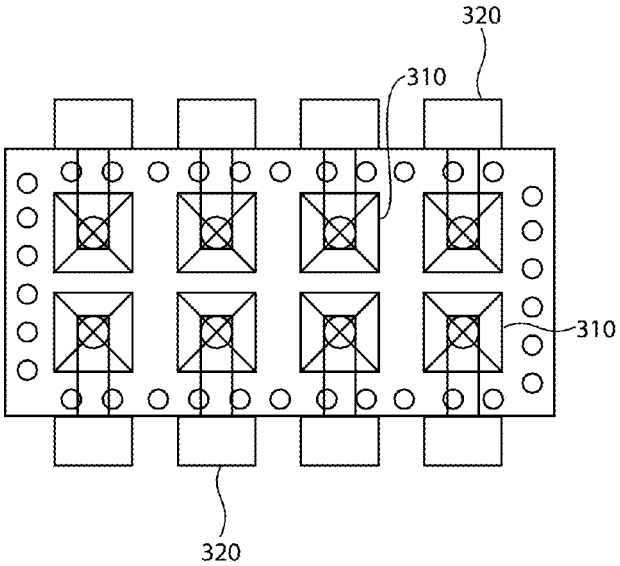
FIG. 3 illustrates a top view of another hot press in accordance with an embodiment.

In another embodiment, the hot press can include one or more pressing units. The pressing unit can include one or more axially aligned push rods, pressing elements, and compression surfaces as described herein. The pressing units can be arranged along a line as shown in FIG. 3, which may help to reduce thermal blocking by adjacent samples and apply even heating to all the samples in the chamber. The pressing units can also be aligned in rows and columns, as illustrated in FIG. 2. Each pressing unit 210 or 310 is coupled to a separate hydraulic ram 220 or 320. Each ram has a pressure control and a flow control and is operated by a single hydraulic system that includes a pump and a frame. The pressure provided by the pump can be split between the hydraulic rams that are coupled to the same frame and applied substantially evenly to the coupled press units.

In another embodiment, the major surface of the pressing element and the compression surface can have substantially the same surface area. The surface area of the major surface and the compression surface can match or be larger than the desired size of a hot pressed sample. For example, the surface area of the compression surface and the major surface can be twice or three times as large as the desired size of the hot pressed sample so that two times or three times more hot pressed products can be manufactured in one operation. After reading this disclosure, one of ordinary skill in the art will understand that the larger product can later be sliced into the regular sizes. In this way, capacity of the hot press and efficiency of manufacturing can be increased.

In another embodiment, the push rod, the pressing element, or the compression surface disclosed herein may not include graphite. Graphite may compete with the ceramic oxide for oxygen and increase the likelihood that the ceramic oxide is reduced. Thus, by not using graphite, a hot press can be used to form a ceramic oxide that is less likely to be reduced as compared to a conventional hot press that has one or more components made of graphite.

The hot press disclosed herein can be used in fabricating ceramic oxides into a multilayer product. The formed layers can be dense or porous. In an embodiment, the multilayer product can have a dense layer and a porous layer. Examples of such product include, but are not limited to, a SOFC, and other multilayer ceramic structure.

A sample that is subject to hot pressing can be applied to the compression surface disclosed herein. For example, the sample can be placed on a platen. In a particular embodiment, the sample can be placed adjacent to the monocrystalline material of the compression surface. The sample can be in the form of a powder, semi-processed, pre-shaped, or any combination thereof. In a particular embodiment, the sample can include a stack of layers, for example, each layer can include a mixture of a ceramic powder and an organic component. The materials in each layer can be the same or different as desired. In an embodiment, the layers in the sample for hot pressing can be formed by conventional methods, such as extrusion, tape-casting or any other method known in the art. In another embodiment, the layer can be pre-sintered. In a further embodiment, each layer of the sample can have substantially the same shape and the same size. The layer can have a rectangular shape, a circular shape or any other shape desired by a certain application of the ceramic product. The size of the sample can vary in accordance with applications of the ceramic product. For example, the size can be 1 cm×1 cm, 2 cm×4 cm, 8 cm×8 cm, or larger. In another embodiment, the shape and the size of each layer can be different if desired.

In yet another embodiment, more than one sample including a stack of layers can be axially aligned and hot pressed simultaneously by using the compression surfaces, such as platens, to separate each sample of stack of layers. In a further embodiment, a spacer can be used to separate the platen and the sample. The spacer can include a material that has the similar coefficient of thermal expansion to that of the platen. In another embodiment, the spacer can include a zirconia, sapphire, or the like.

Samples can be hot pressed in a non-reducing atmosphere. For example, a partial oxygen pressure can be provided. In an embodiment, the partial oxygen pressure can be greater than $10^{-4}$ atmospheric pressure. In a further embodiment, the partial oxygen pressure can be at least $1\times10^{-3}$ atmospheric pressure, or at least $1\times10^{-2}$ atmospheric pressure. In a particular embodiment, the partial oxygen pressure can be at least 0.1 atmospheric pressure to further reduce the likelihood of the sample being reduced during hot pressing. In another embodiment, the partial oxygen pressure may be not greater than 1 atmospheric pressure, not greater than 0.5 atmospheric pressure, or not greater than 0.25 atmospheric pressure. The partial oxygen pressure can be in a range of any of the minimum values to any of the maximum values disclosed herein. For example, the partial oxygen pressure may be within a range of $1\times10^{-3}$ to 1 atmospheric pressure, or within a range of $10^{-2}$ to 0.5 atmospheric pressure. In a further embodiment, hot pressing is performed in air.

A pressure can be applied uniaxially to the samples during hot pressing. Values for pressure are in terms of gauge pressure. The pressure can vary depending on the material of the sample and and desired density. In an embodiment, the pressure is greater than 0 MPa. For example, the pressure can be at least 2 MPa. In another embodiment, the pressure can be at least 5 MPa, at least 8 MPa, or at least 10 MPa, in order to achieve a hot pressed sample with desired density and shape. In another embodiment, the pressure may be not greater than 30 MPa. For example, the pressure may be not greater than 25 MPa, not greater than 20 MPa, not greater than 15 MPa, or not greater than 12 MPa to help to avoid deformation of the hot pressed sample. After reading this specification, a skilled artisan will understand that the pressure can be in a range of from any minimum value to any maximum value disclosed herein. For example, the pressure can be within a range of 0 MPa to 30 MPa, within a range of 2 MPa to 25 MPa, within a range of 5 MPa to 20 MPa, or within a range of 8 MPa to 15 MPa. In a further embodiment, the pressure can be within a range of 0 MPa to 13 MPa.

In a further embodiment, the pressure can be increased in a predetermined loading rate depending on the material and size of the sample. For example, the loading rate can be at least 0.1 tons/min. In another embodiment, the loading rate can be at least 0.5 tons/min, or 2 tons/min. In yet another embodiment, the loading rate may be not greater than 50 tons/min, such as, not greater than 30 tons/min. As disclosed herein, the loading rate can be within a range of any of the minimum values to any of the maximum values. For example, the loading rate can be in a range of 0.1 tons/min to 50 tons/min.

In still another embodiment, the pressure may be decreased after the samples have been kept under the maximum pressure for a desired period of time. For example, the pressure may be reduced to the atmospheric pressure. In a further embodiment, the pressure may be decreased in a predetermined unloading rate depending on the size and material of the sample. For example, the unloading rate may be at least 0.1 tons/min, such as at least 1 tons/min, or 3 tons/min. In another embodiment, the unloading rate may be not greater than 50 tons/min, such as not greater than 40 tons/min, or not greater than 30 tons/min. In a particular embodiment, the unloading rate can be within a range of 0.1 tons/min to 50 tons/min. After reading the specification, a skilled artisan will understand the unloading rate can be within a range of any of the minimum values to any of the maximum values disclosed herein. In yet another embodiment, the loading rate and the unloading rate can be the same. In still another embodiment, the loading rate and the unloading rate can be different.

Heat can also be applied to the samples. In an embodiment, temperature in the chamber can be increased at a predetermined heat rate to the desired hot pressing temperature. However, the heat rate may vary between samples having different sizes, materials, or a combination thereof. Property of the samples can affect the heat rate. Such property can include the ability of the sample to sinter, the thermal conductivity, the desired density, the size, the porosity, and other characteristics. For example, the temperature can be increased at a rate of at least 0.1° C./min, at least 0.5° C./min, at least 1° C./min, at least 2° C./min, at least 5° C./min, at least 7° C./min, or at least 10° C./min. In another embodiment, the temperature may increase at a rate of not greater than 20° C./min, 15° C./min, 10° C./min, or not greater than 5° C./min. The heat rate can be within a range of from any of the minimum values to the maximum values, such as, the rate may be in a range of 0.1° C./min to 20° C./min. After reading this specification, one of ordinary skill in the art will understand that the temperature can increase from the room temperature, at a predetermined rate, to reach an intermediate temperature, such as 500° C., 800° C., or any other suitable temperature, to allow a sufficient time for the organic component in the material to volatilize before increasing the temperature to the peak hot pressing temperature, and then at another predetermined rate to arrive at the peak hot pressing temperature. Such use of different heat rates may help to reduce the temperature gradient between the edge and the center of the sample and formation of cracks within the sample. For example, the temperature can increase to 800° C. at a heat rate, such as 0.1° C. to 20° C./min, and then gradually increase to 1200° C. at a different rate in a range of from 0.1° C./min to 20° C./min. In another embodiment, the same heat rate may be applied to increase the temperature to an intermediate temperature and then to the peak temperature.

The peak hot pressing temperature may vary depending on the material and size of the sample. In an embodiment, the peak hot pressing temperature may be not greater than 1500° C., such as not greater than 1400° C., not greater than 1300° C., or not greater than 1200° C. In a further embodiment, the peak hot pressing temperature can be at least 500° C. For example, at least 700° C. or at least 900° C. The peak hot pressing temperature can be within a range of any of the minimum values and maximum values disclosed herein. For example, the temperature can be increased to be within a range of 500° C. to 1500° C., or within a range of 900° C. to 1200° C.

When a desired peak temperature is reached, the temperature can be held for a predetermined period of time to provide sufficient sintering of the ceramic oxide before cooling down. For example, the samples can be held at the peak temperature, such as 1200° C. for 1 to 4 hours. In an embodiment, hot pressed samples can be left in air to cool down. In another embodiment, the temperature can be decreased in a predetermined rate depending on property of the sample, such as thermal conductivity, the size, and porosity of the sample.

In a further embodiment, the cycle time can extend over a period of time depending on the other parameters, such as the material and size of the sample used in hot pressing. In another embodiment, the cycle time varies depending on the pressure and temperature used. For example, hot pressing can be performed for a longer time to achieve a desired density if a lower pressure or a lower temperature is more suitable for hot pressing a sample. In still another embodiment, the cycle time may be longer because the heat rate is low. In still another embodiment, depending on organic bonding agents used in the ceramic oxides, the cycle time is selected so that sufficient time can be provided to allow the bonding agent to volatilize. In a further embodiment, the cycle time can be up to a week. For example, the cycle time can be at least 2 hours, 3 hours, or at least 5 hours. In a further embodiment, the cycle time can be at least 10 hours, 1 day, or 2 days. In another embodiment, the cycle time may be not greater than a week. For example, the cycle time may not be greater than 5 days, or 4 days. After reading this specification, a skilled artisan will understand that the cycle time can be within a range of from any of the minimum values to any of the maximum values.

In another embodiment, a certain time period ($T_{hpt}$) can be selected to keep the sample being pressed under the temperature that is higher than the intermediate temperature. For example, the $T_{hpt}$ time period can be up to 20 hours. In a further embodiment, the $T_{hpt}$ time period can be at least 1 hour, or at least 2 hours. In another further embodiment, the $T_{hpt}$ time period can be at least 4 hours, or at least 6 hours. In yet another embodiment, the $T_{hpt}$ time period may be not greater than 18 hours, not greater than 15 hours, or not greater than 12 hours. The $T_{hpt}$ time period can be in a range of from any of the minimum values to any of the maximum values disclosed herein. For example, $T_{hpt}$ may be from 1 hour to 20 hours, or from 2 hours to 10 hours.

In a particular embodiment, the sample can be exposed to a temperature gradient. The temperature gradient can be measured between an edge and the center of the sample, and the temperature difference between the edge and the center may be not greater than 50° C., regardless of the size of the sample. For example, the difference may be not greater than 40° C., not greater than 35° C., not greater than 25° C., not greater than 10° C., or not greater than 5° C. In a further embodiment, the hot pressing temperature is maintained such that the temperature difference between the edge and the center is not greater than 25° C.

Embodiments as described herein have benefits as compared to conventional hot press apparatuses. A ceramic oxide formed using an embodiment of the hot press may be less likely to be reduced as compared to the same starting powders being hot pressed in a conventional apparatus. In a particular embodiment, the hot press may not have a die. An oxygen-containing species can more readily reach the ceramic oxide, as a die is not present that would block or potentially inhibit the oxygen-containing species from reaching the ceramic oxide. In another particular embodiment, none of chamber or components within the chamber of the hot press includes graphite, and thus, the oxygen-containing species within the chamber may diffuse relatively more easily to help to maintain a non-reducing or an oxidizing ambient during hot pressing. Accordingly, the hot presses samples are less likely to decompose ceramic oxides or form major cracks. Any one or more of the parameters, as disclosed herein, including the oxygen partial pressure, pressure, hot pressing temperature and time, can help to form ceramic oxides with better quality.

Figure 4:
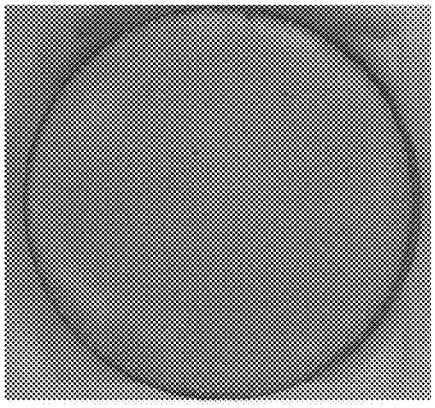
FIG. 4 depicts a top view of a sample hot pressed in accordance with an embodiment.
Figure 5:
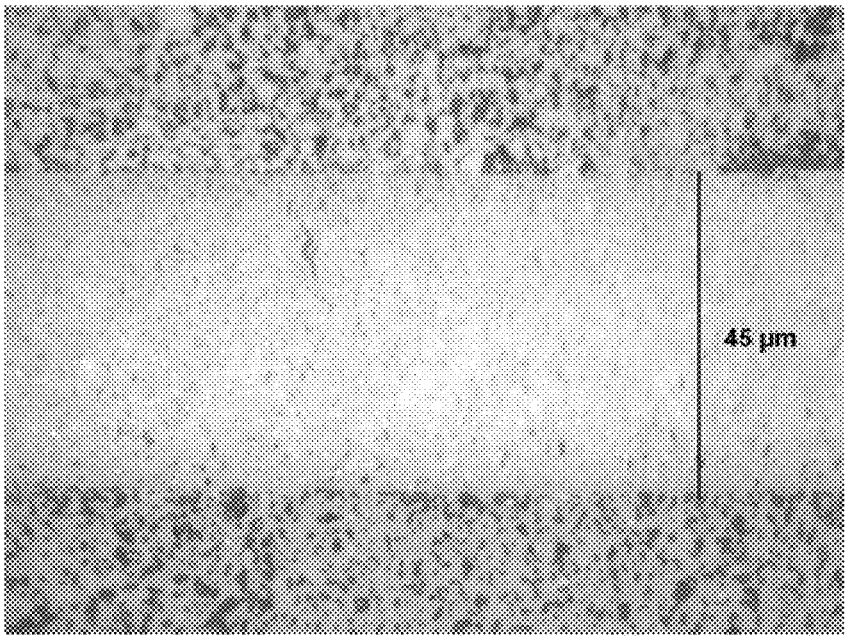
FIG. 5 depicts a cross section view of the hot pressed sample in FIG. 4.
Figure 6:
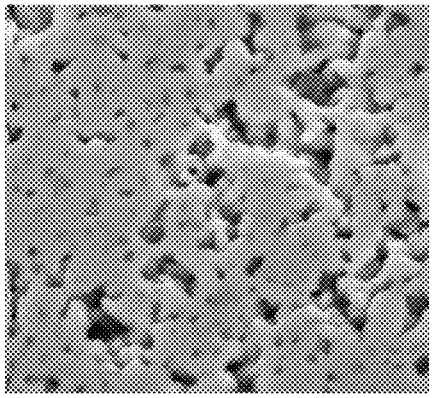
FIG. 6 includes an electronic microscopic view of the hot pressed sample of FIG. 4.
Figure 7:
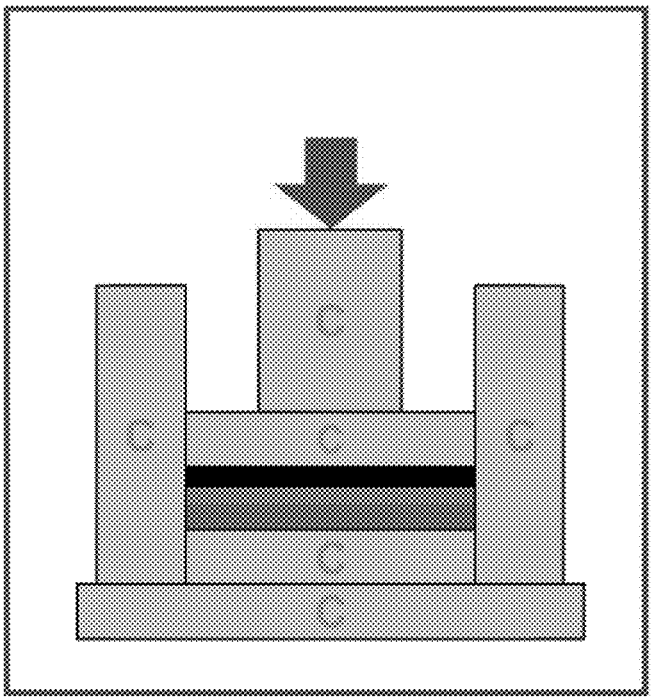
PRIOR ART FIG. 7
FIG. 7 includes a schematic sectional view of a hot press including a die.
Figure 8:
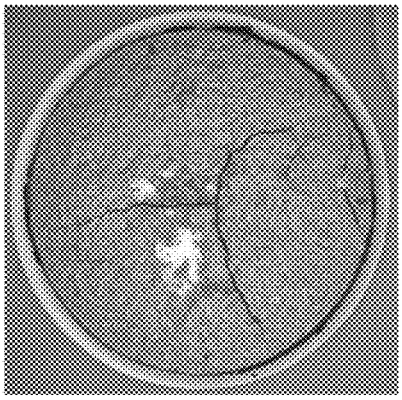
PRIOR ART FIG. 8
FIG. 8 depicts a top view of a sample hot pressed with a die.
Figure 9:
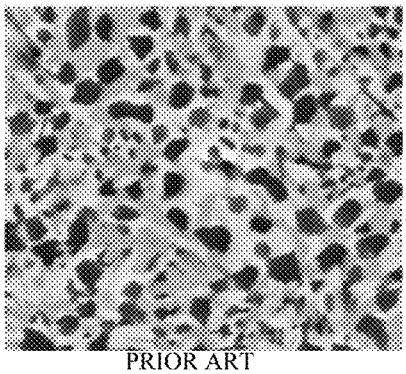
PRIOR ART FIG. 9
FIG. 9 includes an electronic microscopic view of the hot pressed sample of FIG. 8.

FIG. 4 provides a top view of a SOFC sample manufactured with a hot press disclosed herein. The sample includes multiple dense and porous layers as illustrated in FIG. 5. The sample shows no cracks and a substantially uniform dark color. The cathode of the sample was further examined under a scanning electronic microscope. As illustrated in FIG. 6, the cathode does not demonstrate a separate solid phase within the matrix of the material, which indicates decomposition did not take place. A conventional hot press including a die and graphite, as illustrated in FIG. 7, was also used to make a SOFC. The sample made with the conventional hot press had major cracks and darker and brighter regions as shown in FIG. 8. The brighter regions indicate reduction of the anode of the sample, because Ni appears brighter than NiO. Under a scanning electronic microscope, the cathode of the sample demonstrates two phases, namely white and grey regions, as depicted in FIG. 9. The white and grey regions were further analyzed by X-ray diffraction, and loss of strontium was detected in the white regions as compared to the grey regions indicating decomposition of the cathode.

Many different aspects and embodiments are possible. Some of those aspects and embodiments are described herein. After reading this specification, skilled artisans will appreciate that those aspects and embodiments are only illustrative and do not limit the scope of the present invention. Embodiments may be in accordance with any one or more of the items as listed below. Embodiments may be in accordance with any one or more of the items as listed below.

Items

Item 1. A hot press, comprising: a chamber with a heating element; and a first pressing element including a first flared body.

Item 2. A hot press, comprising: a chamber with a heating element; and a first push rod including a silicon carbide.

Item 3. A method of manufacturing a ceramic product including a plurality of layers, comprising: placing a sample on a compression surface in a hot press; and pressing the sample to form the ceramic product including the plurality of layers, wherein during pressing, the hot press does not include a die.

Item 4. A method of forming a ceramic product including a plurality of layers, comprising: placing a sample in a hot press chamber; exposing the sample to a thermal gradient so that a temperature difference between an edge of the sample and a center of the sample is not greater than 25° C.; and pressing the sample to form the ceramic product including the plurality of layers.

Item 5. The method of item 3 or 4, wherein the ceramic product including the plurality of layers is at least a part of a fuel cell or a multilayer ceramic structure.

Item 6. The method of item 3 or 4, wherein pressing the sample comprises pressing with a push rod that has substantially a same length and width as those of the sample.

Item 7. The method of item 4, wherein placing the sample comprises placing the sample on a compression surface.

Item 8. The method of any one of items 3 and 5 to 7, comprising placing a spacer between the compressions surface and the sample.

Item 9. The method of item 8, wherein the spacer includes sapphire, an aluminum oxide, a silicon carbide, a zirconia, or any combination thereof.

Item 10. The method of any one of items 3 to 9, comprising using a partial oxygen pressure of at least 1×10 4 atmospheric pressure, at least 5×10-4 atmospheric pressure, or at least 1×10-3 atmospheric pressure.

Item 11. The method of any one of items 3 to 10, comprising using a partial oxygen pressure not greater than 1 atmospheric pressure, not greater than 0.5 atmospheric pressure, or not greater than 0.25 atmospheric pressure.

Item 12. The method of any one of items 3 to 11, comprising using a partial oxygen pressure within a range of 1×10-4 to 1 atmospheric pressure, within a range of 5×10-4 to 0.5 atmospheric pressure, or within a range of 1×10-3 to 0.25 atmospheric pressure.

Item 13. The method of any one of items 3 to 12, wherein pressing comprises pressing in air.

Item 14. The method of any one of items 3 to 13, wherein pressing comprises uniaxial pressing.

Item 15. The method of any one of items 3 to 14, wherein pressing comprises applying to the sample a pressure of at least 2 MPa, at least 5 MPa, at least 8 MPa, or at least 12 MPa.

Item 16. The method of any one of items 3 to 15, wherein pressing comprises applying to the sample a pressure of not greater than 30 MPa, not greater than 20 MPa, not greater than 15 MPa, or not greater than 12 MPa.

Item 17. The method of any one of items 3 to 16, wherein pressing comprises applying to the sample a pressure in a range of 2 MPa to 30 MPa, in a range of 5 MPa to 20 MPa, or in a range of 8 MPa to 12 MPa.

Item 18. The method of any one of items 2 to 17, wherein pressing including pressing the sample at a temperature of not lower than room temperature, at least 500° C., at least 700° C., or at least 900° C.

Item 19. The method of any one of items 2 to 18, wherein pressing including pressing the sample at a temperature of not greater than 1500° C., not greater than 1400° C., or not greater than 1300° C.

Item 20. The method of any one of items 2 to 19, wherein pressing including pressing the sample at a temperature of in a range of room temperature to 1500° C., in a range of 500° C. to 1400° C., or in a range of 700° C. to 1300° C.

Item 21. The method of any one of items 4 to 20, wherein pressing comprises pressing the samples for at least 2 hours, at least 3 hour, or at least 5 hours.

Item 22. The method of any one of items 3 to 21, wherein pressing comprises pressing the samples for not greater than 1 week, not greater than 5 days or not greater than 4 days.

Item 23. The method of any one of items 3 to 22, wherein pressing comprises pressing the samples for 2 hours to a week, 3 hours to 5 days, or 5 hours to 4 days.

Item 24. The hot press or the method of any one of items 2 to 5 and 7 to 23, wherein the hot press comprises a first pressing element including a first flared body.

Item 25. The hot press or the method of item 1 or 24, wherein the first flared body has a shape of a trapezoid prism.

Item 26. The hot press or the method of item 1, 24, or 25, wherein the flared body comprises side surfaces extend to intersect a first major surface.

Item 27. The hot press or the method of any one of items 1 and 24 to 26, wherein the first pressing element includes a silicon carbide, an aluminum oxide, a zirconia, or any combination thereof.

Item 28. The hot press or the method of any one of items 1 and 24 to 27, wherein the hot press comprises a second pressing element including a second flared body.

Item 29. The hot press or the method of item 28, wherein the second flared body has a shape of trapezoid prism.

Item 30. The hot press or the method of item 28 or 29, wherein the second flared body comprises side surfaces having a trapezoid shape.

Item 31. The hot press or the method of any one of items 26 to 30, wherein the second pressing element comprises a silicon carbide, an aluminum oxide, a zirconia, or any combination thereof.

Item 32. The hot press or method of any one of items 1 and 3 to 31, wherein the hot press comprises a first push rod including a silicon carbide.

Item 33. The hot press or method of any one of items 1 and 3 to 32, wherein the hot press comprises a first push rod consisting of a silicon carbide.

Item 34. The hot press or method of any one of items 2, 32, and 33, wherein the first push rod is hollow.

Item 35. The hot press or method of any one of items 1 to 34, wherein the hot press comprises a second push rod including a silicon carbide.

Item 36. The hot press or method of any one of items 1 to 34, wherein the hot press comprises a second push rod consisting of a silicon carbide.

Item 37. The hot press or method of item 35 or 36, wherein the second push rod is hollow.

Item 38. The hot press or the method of item 35, 36, or 37, wherein the first push rod and the second push rod are aligned in an axial direction.

Item 39. The hot press or the method of any one of items 35 to 38, wherein the first push rod is coupled to the first pressing element and the second push rod is coupled to the second pressing element.

Item 40. The hot press or the method of any one of items 1 to 39, wherein the hot press comprises a first compression surface including a silicon carbide, an aluminum oxide, a zirconia, or any combination thereof.

Item 41. The hot press or the method of any one of items 1 to 39, wherein the hot press comprises a first compression surface comprising a first layer including a monocrystalline material and a second layer including a polycrystalline material, wherein the monocrystalline material and polycrystalline material include a same primary compound.

Item 42. The hot press or the method of any one of items 1 to 41, wherein the hot press comprises a second compression surface.

Item 43. The hot press or the method of item 42, wherein the second compression surface comprises a silicon carbide, an aluminum oxide, a zirconia, or any combination thereof.

Item 44. The hot press or the method of item 42, wherein the second compression surface comprising a third layer including a monocrystalline material and a fourth layer including a polycrystalline material, wherein the monocrystalline material and polycrystalline material include a same primary compound.

Item 45. The hot press or the method of any one of items 42 to 44, wherein the first compression surface and the second compression surface are aligned in an axial direction.

Item 46. The hot press or the method of any one of items 41, 44, and 45, wherein the monocrystalline material includes sapphire.

Item 47. The hot press or the method of any one of items 41 and 44 to 46, wherein the polycrystalline material includes an aluminum oxide.

Item 48. The hot press or the method of any one of items 42 to 47, wherein the first compression surface is coupled to the first pressing element and the second compression surface is coupled to the second pressing element.

Item 49. The hot press or the method of any one of items 41 and 44 to 49, wherein the first major surface of the first pressing element is coupled to the polycrystalline material of the pressing element, and the second major surface of the second pressing element is coupled to the polycrystalline material of the second compression surface.

Item 50. The hot press of item 1 or 2, comprising a pressing unit including a plurality of compression surfaces aligned in an axial direction.

Item 51. The hot press of item 50, comprising a plurality of the pressing units arranged in rows and columns.

Item 52. The hot press of item 50 or 51, further comprising a heat insulation material including an alumina fiber.

Item 53. The hot press or the method of any one of items 3 to 52, wherein the hot press comprises a chamber including a heating element.

Item 54. The hot press of any one of items 1, 2 and 53, wherein the heating elements comprises a SiC, MoSi2, or any combination thereof.

Item 55. The hot press or the method of any one of items 1, 2, and 4 to 54, wherein the hot press does not include a die or a mold.

Item 56. The hot press or the method of any one of items 3 to 55, wherein the ceramic product comprises a dense layer and a porous layer.

Item 57. The hot press or the method of any one of items 3 to 56, wherein the sample comprises a plurality of layers, each layer including a different material.

Note that not all of the activities described above in the general description or the examples are required, that a portion of a specific activity may not be required, and that one or more further activities may be performed in addition to those described. Still further, the order in which activities are listed is not necessarily the order in which they are performed.

Certain features that are, for clarity, described herein in the context of separate embodiments, may also be provided in combination in a single embodiment. Conversely, various features that are, for brevity, described in the context of a single embodiment, may also be provided separately or in any subcombination. Further, reference to values stated in ranges includes each and every value within that range.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the items.

What is claimed is:

1. A hot press, comprising:

a chamber with a heating element, wherein the chamber includes an upper wall; and first pressing element including a first flared body positioned within the chamber and adjacent the upper wall of the chamber, wherein the first flared body includes an expanded major surface facing away from the upper wall of the chamber.

2. The hot press of claim 1, wherein the hot press does not include a die or a mold.

3. The hot press of claim 1, wherein the first pressing element includes a silicon carbide, an aluminum oxide, a zirconia, or any combination thereof.

4. The hot press of claim 1, wherein the hot press comprises a first compression surface comprising a first layer including a monocrystalline material and a second layer including a polycrystalline material, wherein the first compression surface is adjacent the expanded major surface, and wherein the monocrystalline material and polycrystalline material include a same primary compound.

5. The hot press of claim 4, wherein the monocrystalline material includes sapphire.

6. The hot press of claim 4, wherein the polycrystalline material includes an aluminum oxide.

7. The hot press of claim 4, wherein the hot press comprises a second compression surface comprising a third layer including a monocrystalline material and a fourth layer including a polycrystalline material, wherein the monocrystalline material and polycrystalline material include a same primary compound.

8. The hot press of claim 7, wherein the first compression surface and the second compression surface are aligned in an axial direction.

9. The hot press of claim 1, wherein the hot press comprises a second pressing element including a second flared body.

10. A hot press, comprising:

a chamber with a heating element;

a first push rod including a silicon carbide; and a first pressing element positioned within the chamber and adjacent the first push rod.

11. The hot press of claim 10, wherein the hot press does not include a die or a mold.

12. The hot press of claim 10, further comprising a first compression surface including a silicon carbide, an aluminum oxide, a zirconia, or any combination thereof, wherein the first compression surface is adjacent the first pressing element.

13. The hot press of claim 10, wherein the hot press comprises a second push rod including a silicon carbide and aligned in an axial direction with the first push rod.

14. The hot press of claim 10, comprising a pressing unit including a plurality of compression surfaces aligned in an axial direction.

15. The hot press of claim 14, comprising a plurality of the pressing units arranged in rows and columns.

16. A method of manufacturing a ceramic product including a plurality of layers, comprising:

placing a sample on a compression surface in a hot press; and pressing the sample to form the ceramic product including the plurality of layers, wherein during pressing, the hot press does not include a die.

17. The method of claim 16, wherein the ceramic product including the plurality of layers is at least a part of a fuel cell or a multilayer ceramic structure.

18. The method of claim 16, comprising placing a spacer between the compression surface and the sample.

19. The method of claim 18, wherein the spacer includes sapphire, an aluminum oxide, a silicon carbide, a zirconia, or any combination thereof.

20. The method of claim 16, comprising exposing the sample to a thermal gradient so that a temperature difference between an edge of the sample and a center of the sample is not greater than 25° C.

* * * * *